US005246134A

United States Patent [19]

Roth et al.

[11] Patent Number: 5,246,134

[45] Date of Patent: Sep. 21, 1993

[54] PRESS-ON CLOSURE WITH PEELABLE END PANEL

[75] Inventors: Donald J. Roth, Westport; Donald G. Sauer, Harwinton; Robert W. Fraser, Stamford, all of Conn.

[73] Assignee: Polystar Packaging, Inc., Norwalk, Conn.

[21] Appl. No.: 812,026

[22] Filed: Dec. 23, 1991

[51] Int. Cl.[5] ..... B65D 41/00

[52] U.S. Cl. ..... 220/359; 220/270; 215/232; 229/125.17

[58] Field of Search ..... 220/359, 356, 240, 270; 215/232; 229/125.17, 125.35

[56] References Cited

U.S. PATENT DOCUMENTS

| | | | |
|---|---|---|---|
| 2,350,950 | 6/1944 | Wiley | 220/356 X |
| 4,650,088 | 3/1987 | Hirota et al. | 220/359 X |
| 4,856,708 | 8/1989 | Giasi | 220/359 X |

*Primary Examiner*—Allan N. Shoap
*Assistant Examiner*—Paul A. Schwarz
*Attorney, Agent, or Firm*—William H. Holt

[57] ABSTRACT

A press-on closure 10 for a tubular container 12. The closure includes a molded plastic frame 14 having a ledge 28 on which an end panel 16 is seated and to which the end panel is peelably secured. The end panel has a free outer peripheral edge unbonded to the frame. The resultant closed container is subject to retorting with the result that heretofore the end panel could axially outwardly deform and possibly initiate internal peeling. To prevent this peeling, the frame is provided with a thin flexible integral flange 36 forming a continuation of the ledge on which the end panel is seated. The end panel is also peelably bonded to the flange and the flange deforms or deflects with the end panel. The frame has a press fit onto the container, which is preferably in the form of a metal can, which at the end thereof to be closed by the closure is provided with a radially outwardly directed curl 48. The curl terminates in a raw edge 54 and is so shaped that when it is seated within a groove in the underside of the frame, the raw edge is embedded in a skirt portion of the frame to permanently and sealingly lock the curl within the frame.

13 Claims, 2 Drawing Sheets

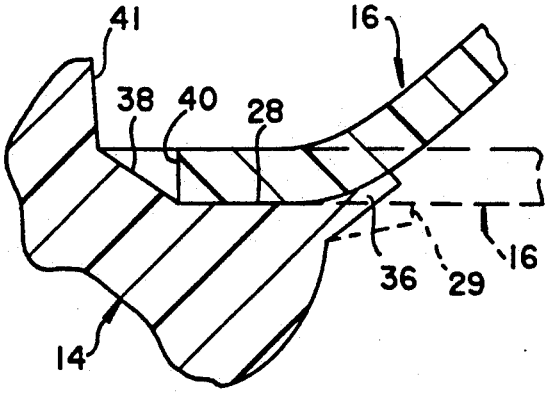
Fig.4
Fig.3
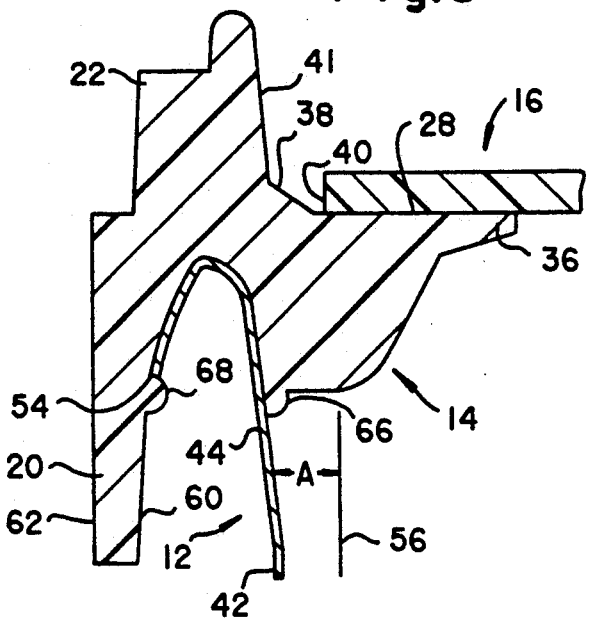
Fig.5
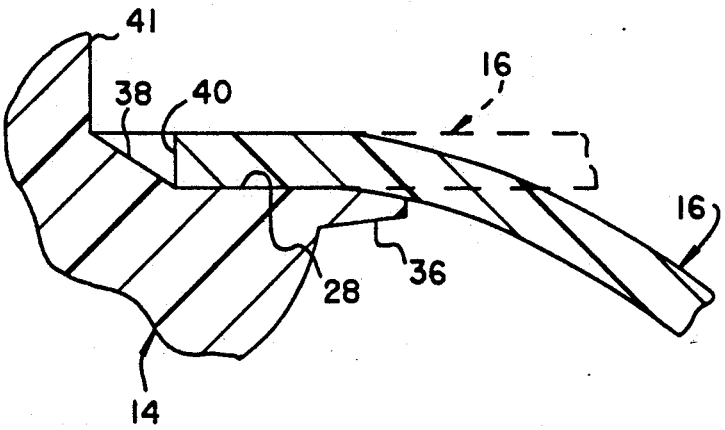
Fig.6
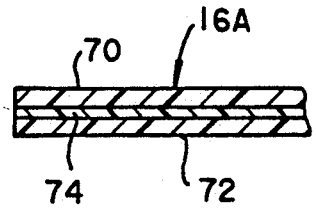

PRESS-ON CLOSURE WITH PEELABLE END PANEL

This invention relates in general to new and useful improvements in closures for containers, particularly containers which have a tubular body and an open end which is to be closed by a closure such as an end unit.

BACKGROUND OF INVENTION

There have been developed closures for containers, particularly cans, which include removable end panels. These closures include a peripheral frame having peelably bonded thereto an end panel. When containers incorporating such closures are subjected to post-filling treatment including retorting or high vacuum, positive or negative pressure is built up within the container with the result that the end panel flexes axially outwardly or inwardly and has a tendency to internally initiate peeling from the frame. This can result in improperly sealed containers.

Another problem with closures of this type is the securement of the closure to the container. There is a great need for a closure which can be tightly sealed and permanently attached to a container by merely applying heat and an axial pressure on the closure after it has been seated on the container.

SUMMARY OF THE INVENTION

One feature of the invention is the forming of a closure which includes a frame, formed of thermoplastic material, defining an axially outwardly facing ledge on which there is seated a peripheral portion of an end panel with that peripheral portion being peelably bonded to the ledge. The end panel is formed of a flexible material and should there be internal pressure different from atmospheric pressure, such as during pressure cooking or vacuum processing, the end panel will bulge either outwardly or inwardly. During any outward bulging of the end panel, such as during a retort operation, there was a tendency for the end panel to begin peeling from the ledge at the inner edge of the ledge. In accordance with this invention, the frame is provided with a radially inwardly extending flange which forms an extension of the ledge. The frame is formed of a flexible material and the flange, being very thin and being peelably bonded to the underside of the end panel, can flex with the end panel and eliminate any internally initiated peeling of the end panel from the frame. The area of adhesion between the end panel and the flange will experience shear forces instead of forces tending to peel the end panel from the frame.

Another feature of the closure is the formation of the frame on the underside thereof with a downwardly opening groove in which there is received a curl formed at the end of a container. The container curl terminates in a raw edge which in accordance with the configuration of the frame becomes embedded in the thermoplastic frame and serves to protect the raw edge against corrosion as well as to lock the frame on the container.

Most specifically, the closure frame includes a depending skirt which has an upper part forming part of the groove. This skirt is deformable under heat and pressure as the frame is being forced down onto the container curl and aids in the reception of the raw edge of the container.

Another feature of the invention is to provide for easier opening of the end panel by forming a sloped surface on the frame which precludes bonding to the peripheral edge of the end panel.

With the above and other objects in view that will hereinafter appear, the nature of the invention will be more clearly understood by reference to the following detailed description, the appended claims, and the several views illustrated in the accompanying drawings.

FIG. 3 is a view similar to FIG. 2 but showing the closure interlocked with the container curl after heat and axial pressure have been applied to the closure.

FIG. 4 is a fragmentary sectional view showing the deformation of the end panel of the closure due to internal pressure within the container.

FIG. 5 is a fragmentary vertical sectional view similar to FIG. 4 and shows the deformation of the end panel in response to a vacuum within the container.

FIG. 6 is a fragmentary sectional view showing a modified form of end panel.

DESCRIPTION OF PREFERRED EMBODIMENT OF INVENTION

Figure 1:
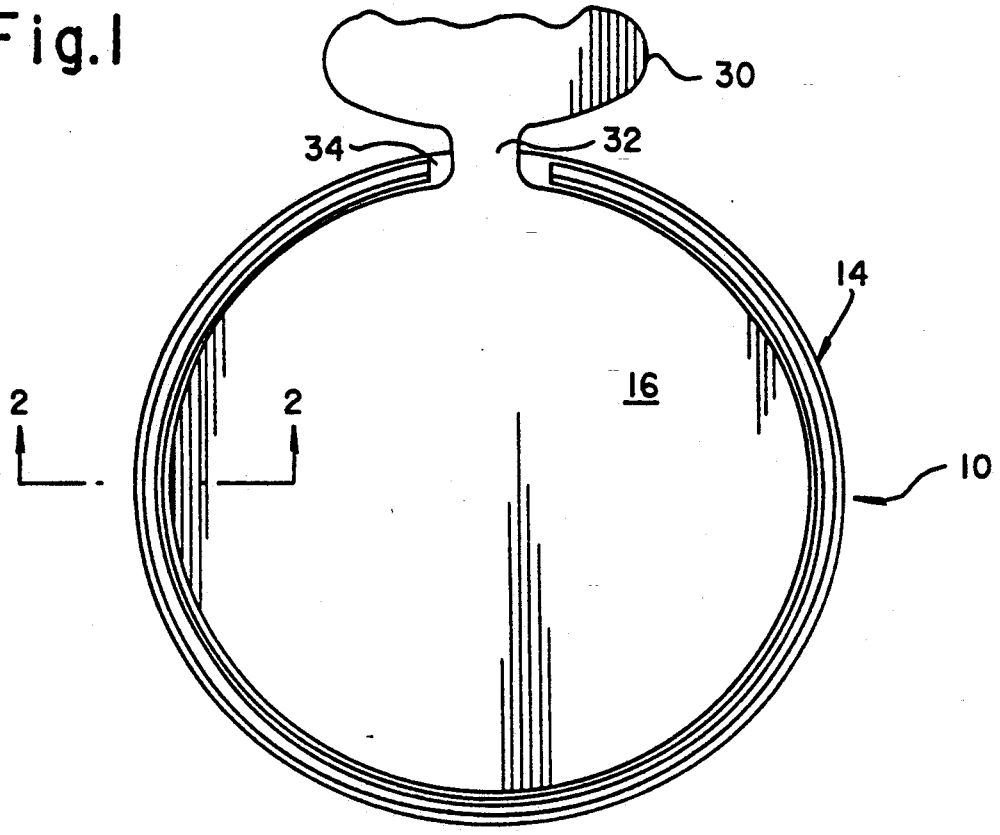
FIG. 1 is a top plan view of a container closed with a closure formed in accordance with this invention.

Referring now to the drawings in detail, it will be seen that there is illustrated a closure which is generally identified by the numeral 10 which closes one open end of a container generally identified by the numeral 12. The closure 10 includes a molded plastic frame, generally identified by the numeral 14, which carries a peelable plastic end panel generally identified by the numeral 16.

The basic concept of the molded plastic frame 14 and a peelable end panel 16 is the subject of a pending application and will not be described in complete detail here. However, it is to be understood that the frame 14 is formed of a resilient plastic material, such as polypropylene, which may be readily injection molded. In a like manner, the end panel 16 will be formed of a flexible plastic material which may be polypropylene, or other resin, or which may be a laminate, as will be described in more detail hereinafter.

The frame 14 includes a body 18 which has depending from a radially outer part thereof a skirt 20. The frame also includes an upstanding ridge 22 which stiffens the frame 14. The ridge 22 further includes an upstanding rim 24 which together with the ridge 22 defines an annular recess 26. This recess 26 has a lower boundary in the form of a ledge 28 on which an outer peripheral part of the end panel is suitably bonded.

As is best shown in FIG. 1, in order to open the container, the end panel 16 is provided with a pull tab 30 which is attached to the end panel 16 by a strap 32. The ridge 22 and the rim 24 are notched as at 34 to receive the strap 32.

The closure 10 as described to this point is known in the art.

It is to be understood that the closed container 12 is subject to internal high pressures and vacuums different from atmospheric pressure. For example, the product may be one which must be retorted after filling and the high temperature of the retort results in an internal expansion of the product and gases in the head space with the result that the flexible end panel 16 will bulge outwardly as is schematically shown in FIG. 4. It has been found in the past that the outward bulging of the end panel 16 can result in the initiation of peeling of the end panel 16 from the ledge 28 beginning at the inner edge 29 of the ledge 28.

In accordance with this invention, the frame 14 has been modified with respect to prior frames by the addition of a radially inwardly directed flange 36 which has an outer surface which forms a continuation of the ledge 28. The flange 36 is thin and relatively flexible as compared to the relatively inflexible ledge 28 and other portions of the frame 14 so that flange 36 is readily deformable.

Inasmuch as the end panel 16 is also peelably bonded to the flexible flange 36, it will be seen that when there is internal pressure applied against the end panel 16 and the end panel 16 bows axially outwardly or upwardly, as shown in FIG. 4, instead of an edge of the securement between the end panel 16 and the ledge 28 being available, there is the flange 36 which is free to bend with the end panel 16 and there is no adequate peeling force to initiate peeling between the end panel 16 and the frame 14 at inner edge 29.

Referring now to FIG. 5, it will be seen that the flexibility of flange 36 in no way detracts from the radially inwardly directed deflection of the end panel 16 in the event a vacuum is drawn within the container 12.

In the past, the ledge 28 has been formed by notching the upper surface of the frame 14. As a result, the peripheral edge of the end panel 16 opposed an upstanding surface of the frame 14 and had a tendency to bond thereto so as to restrict easy opening of the end panel 16. In the present construction of the frame 14, this direct notch arrangement is eliminated and the surface of the frame 14 which forms a continuation of the ledge surface slopes upwardly and radially outwardly to provide a sloped surface as at 38 so that a free edge 40 of the end panel 16 remains free of upstanding wall 41. This allows for easier opening when the end panel 16 is being peeled to an open position with respect to the frame 14.

ATTACHMENT OF CLOSURE TO CONTAINER

The preferred container 12 is in the form of a metal can which includes a tubular body 42. The body 42 is closed at the opposite end thereof (not shown) in any conventional manner. Container body 42 includes an upper portion 44 which at its extreme end terminates in a radially outwardly and downwardly directed curl 48. The curl 48 includes an inner part 50 which is an integral extension of upper portion 44. Next, the curl 48 includes a reversely turned part 52 which depends downwardly and outwardly and terminates in a free raw edge 54.

As shown in FIG. 3, the upper portion 44 of container 12 is disposed at an angle A to a vertical line 56. This angle A may vary between 0 degrees and 25 degrees with a preferred angle A being about 15 degrees.

As previously described, the frame 14 includes a lowermost and outermost depending skirt 20. This skirt is elongated and is tapered in wall thickness so as to be of a minimum wall thickness at the free lower end thereof. The skirt 20 includes an inner wall surface 60 and an outer wall surface 62.

Figure 2:
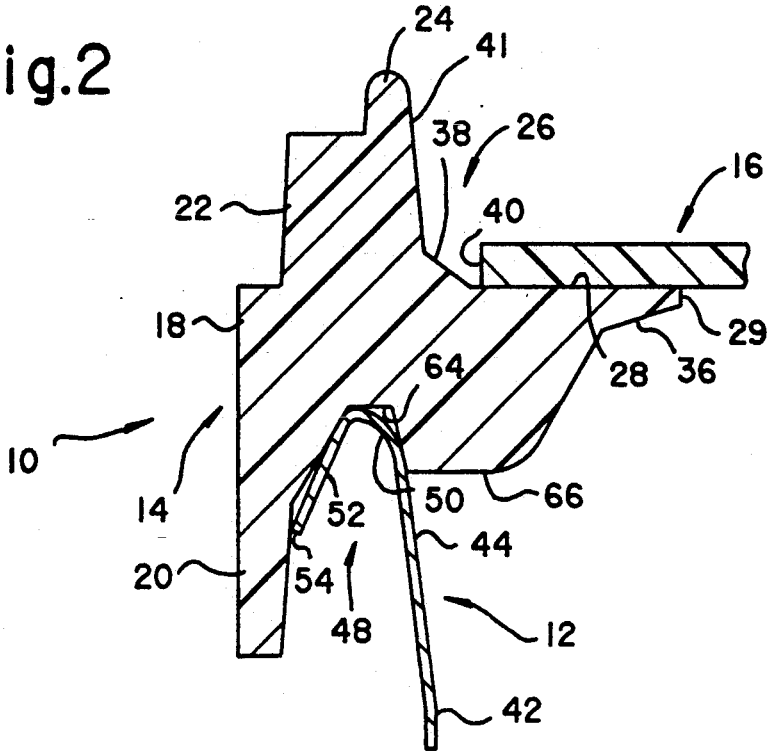
FIG. 2 is a fragmentary transverse vertical sectional view taken generally along the line 2—2 of FIG. 1 and shows the specific construction of the closure resting upon a specifically formed curl at the top end of the container incident to the start of attaching the closure to the container.

The upper portion of the skirt 20 forms a radially outer portion of the wall surface of a downwardly opening groove 64, a preferred shape of which is shown in FIG. 2. The groove 64 at its radially inner end terminates in a reversely curved radially innermost lower part 66 of the frame 14.

The container 12 is to be closed at its upper portion 44 by having the closure 10 applied thereto simply by seating the closure 10 on the curl 48 and applying a downward force on the ridge 22 generally in vertical alignment with the curl 48 and axially of container 12. As a result, the curl 48 is forced into groove 64. Curl 48 is preferably heated by induction heating and causes softening and/or slight melting of the ceiling and walls of groove 64 to get proper penetration of curl 48 into frame 14 and assure a good adhesive bond. Because of the softness of the frame 14, as the curl 48 enters into the groove 64, it becomes seated therein and due to its angular relationship to the vertical, at angle A, as the curl 48 seats in the groove 64, the raw edge 54 becomes embedded in the upper part of the skirt 20 as is clearly shown in FIG. 3. The softened, and molten, portion of the frame 14 forms an inner bead 66 and an outer bead 68. The outer bead 68 not only functions to embed raw edge 54, it serves to permanently lock the closure 10 onto the container 12 under all conditions of use including the time in which the container 12 is internally pressurized as the result of heating of the product when retorted.

Inasmuch as the curl 48 is in adhesive engagement with the underside of the frame 14 within the recess 64, a pressure seal is formed.

In FIGS. 3-5 the end panel 16 has been illustrated as being of a single thickness. When the product which is packaged is sensitive to gases permeating through the closure, the end panel may be of a construction as illustrated in FIG. 6 wherein an end panel 16A is illustrated. This end panel is of a laminated construction including an outer layer 70, an inner layer 72 and an intermediate layer 74. The layers 70 and 72 are preferably formed of polypropylene or like plastic while the inner layer is a barrier layer and is preferably formed of a barrier plastic such as EVOH, PVDC or similar materials.

Although only a preferred embodiment of the closure including the mounting of the end panel with respect to the frame and the mounting of the closure on the container have been specifically illustrated and described herein, it is to be understood that variations may be made within the scope of the invention as defined by the appended claims.

We claim:

1. A closure comprising an open frame defining an inner peripheral ledge, an end panel extending across said frame and having a radially outer peripheral part seated on said ledge in sealed peelable relation with said ledge, said end panel being subjectable to axial bowing which could result in internally initiated peeling of said end panel from said ledge, said closure being improved by said frame having a radially inwardly projecting flexible flange forming an extension of said ledge, said flexible flange being bonded to said end panel and being bowable with said end panel for preventing such internally initiated peeling, and said end panel having a pull tab for peeling said end panel from said ledge and said flexible flange.

2. A closure according to claim 1 wherein said flange is an integral part of said frame.

3. A closure according to claim 1 wherein said end panel has a free outer peripheral edge.

4. A closure according to claim 1 wherein said frame has means for sealing attachment to an open ended container.

5. A closure according to claim 1 wherein said frame is of a molded plastic construction.

6. A closure according to claim 5 wherein said frame is particularly shaped for receiving a reversely and radially outwardly turned curl of a container in sealed relation.

7. A closure according to claim 5 wherein said frame is particularly shaped for receiving reversely and radially outwardly turned curl of a container in mechanically interlocked sealed relation.

8. A closure according to claim 7 wherein said frame configuration includes a downwardly opening groove in an underside of said frame, said groove being in part defined by an outer depending skirt depending beyond said groove.

9. A closure according to claim 7 wherein said end panel has a free outer peripheral edge, said ledge having an outwardly extending portion sloping upwardly away from said free peripheral edge of said end panel and terminating at an upstanding wall of said frame.

10. A closure and container assembly, said assembly comprising a container having an open end defined by a reversely turned curl terminating in an outermost raw edge, and a closure including a peripheral plastic frame formed of heat-softenable plastic, said frame being of a configuration including a downwardly opening groove receiving said curl, said groove being in part defined by a downwardly sloping plastic skirt forming part of said plastic frame, means usable for inductively heating and softening said plastic skirt, and said raw edge being embedded in said plastic skirt; said frame defining a radially inwardly positioned ledge which faces axially outwardly, a flexible end panel seated on said ledge and sealed to said ledge in inwardly peeling relation, and said frame having a flexible flange with an axially outwardly facing surface forming a continuation of said ledge, said flexible flange being bonded to said end panel and being capable of flexing with said end panel without peeling, and a pull tab carried by said end panel for peeling said end panel from said ledge and said flexible flange.

11. An assembly according to claim 10 wherein a radially inner part of said curl forms an angle with an axis of said container and has an interference fit with a like part of said groove for forcing said raw edge into said skirt in interlocking relation.

12. An assembly according to claim 11 wherein said angle is on the order of 0 to 25 degrees.

13. An assembly according to claim 11 wherein said curl is generally of an inverted V cross section.

* * * * *